United States Patent [19]

Lancaster

[11] Patent Number: 4,901,863

[45] Date of Patent: Feb. 20, 1990

[54] METHOD AND APPARATUS FOR SORTING WOOD CHIPS

[76] Inventor: James G. Lancaster, 3291 Hillard Dr., Birmingham, Ala. 35243

[21] Appl. No.: 101,422

[22] Filed: Sep. 28, 1987

[51] Int. Cl.[4] ..... B07B 1/14; B07B 1/22

[52] U.S. Cl. ..... 209/664; 209/296; 209/672; 209/288

[58] Field of Search ..... 209/664, 667, 672, 284, 209/288, 234, 235, 406, 361, 293, 296

[56] References Cited

U.S. PATENT DOCUMENTS

| | | | |
|---|---|---|---|
| 860,147 | 7/1907 | Orton | 209/672 |
| 1,200,241 | 10/1916 | Ritchie | 209/672 |
| 1,704,203 | 3/1929 | Medcalf | 209/630 |
| 4,377,474 | 3/1983 | Lindberg | 209/279 |
| 4,396,501 | 8/1983 | Morey | 209/10 |
| 4,430,210 | 2/1984 | Tuuha | 209/672 |
| 4,452,694 | 6/1984 | Christensen et al. | 209/672 |
| 4,522,344 | 6/1985 | Morey | 241/79 |
| 4,653,648 | 3/1987 | Bielagus | 209/672 |
| 4,658,965 | 4/1987 | Smith | 209/672 |

FOREIGN PATENT DOCUMENTS

| | | | |
|---|---|---|---|
| 82670 | 10/1953 | Netherlands | 209/664 |
| 1087428 | 4/1984 | U.S.S.R. | 209/913 |

OTHER PUBLICATIONS

Christie, R. D., "Chip Screenings for Pulping Uniformity," *1986 Pulping Conference,* pp. 551–561 (1986).

Christie, R. D., "Chip Thickness and Its Effect on Pulping Needs Further Study," *Pulp & Paper Canada* 87:9 (1986).

"RDS Radar Disc Screen" (copyright 1978).

"Disc Scalping Conveyor," West Salem Machinery Company–no date.

*Primary Examiner*—Robert B. Reeves

*Assistant Examiner*—Donald T. Hajec

*Attorney, Agent, or Firm*—L. F. Hilbers

[57] ABSTRACT

A wood chip sorter comprises a shell (22) which at least partially defines a substantially cylindrical sorting chamber (26) into which wood chips are introduced. The shell (22) has a plurality of rotatable shafts (28) mounted thereon with the axes (72) of the shafts (28) being circularly arranged about a central axis (24) of the shell (22). Each shaft (28) has a plurality of discs (80) mounted at spaced intervals thereon with discs of adjacent shafts (28) intermeshing radially to form essentially axial spaces (84) therebetween. A drive and transmission system (30) revolve the shell (22) about the central axis (24) of the shell (22). A planetary gear system (32) facilitates rotation of the shafts (28) about their axes (72) as the shell (22) revolves. The discs (80) are shaped to have greatest axial width at central portions thereof, and taper to a lesser axial width at their circumference. The discs (80) are formed from an abrasion-resistant material. Compressible spacer members (82) are mounted between adjacent discs on a shaft. An inlet (34) is configured to include a helically threaded feed member (46) which extends into the shell (22) and along the central axis (24) thereof. The inlet (120) facilitates input of the wood chips so that chips in a desired thickness range have the opportunity to pass through the axial spaces (84) existing between intermeshing, (80) discs of adjacent shafts (28).

18 Claims, 4 Drawing Sheets

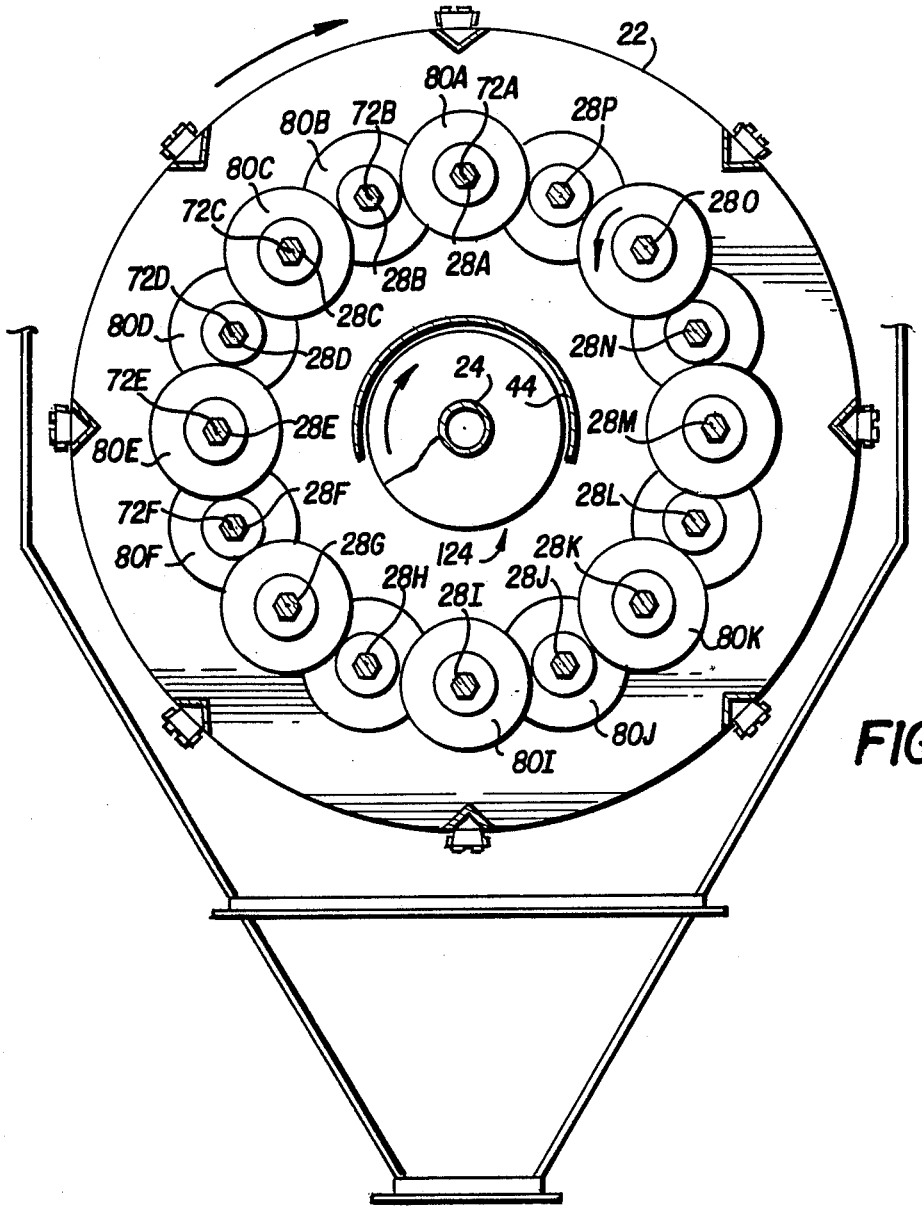
FIG. 2
FIG. 4A
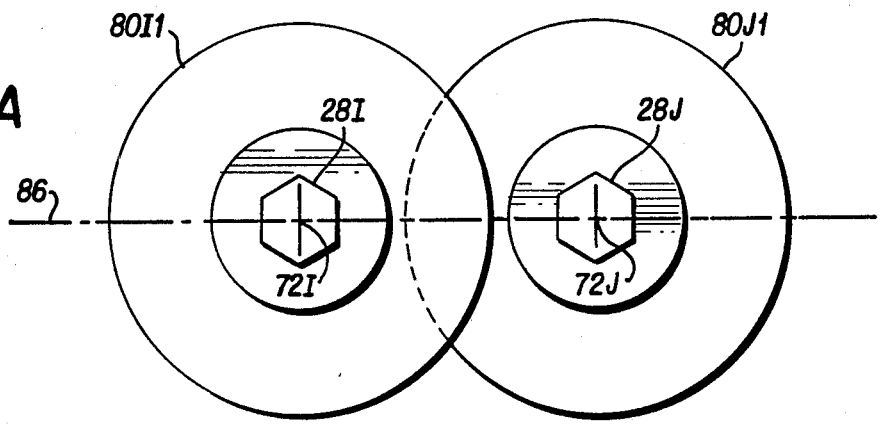

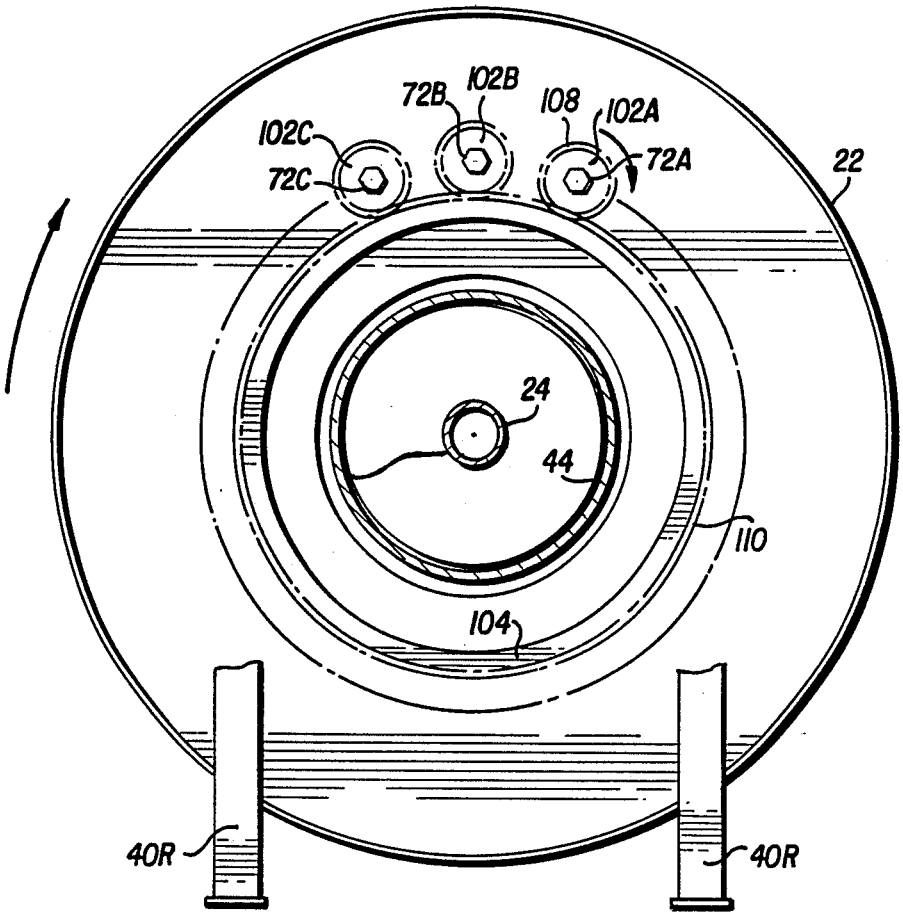
FIG. 5
FIG. 4C
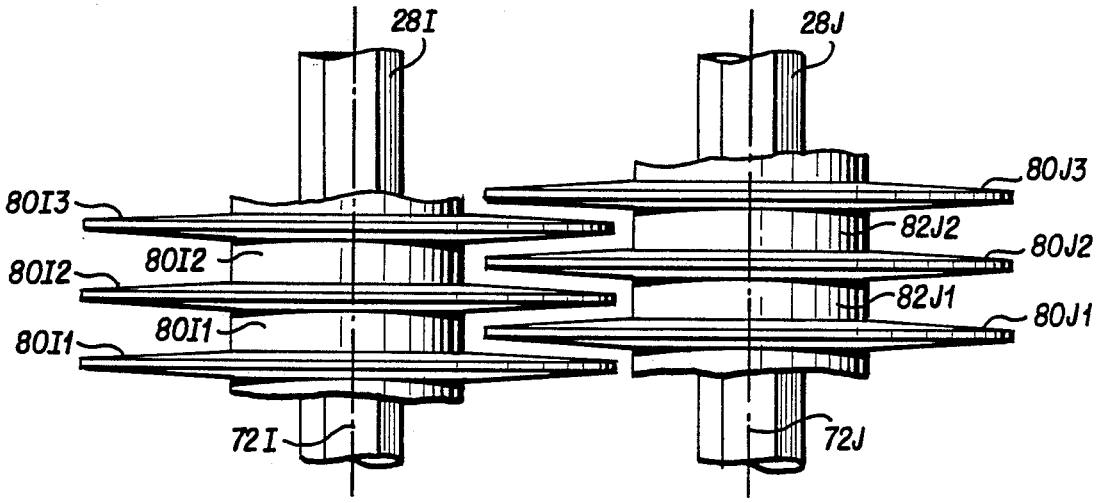

METHOD AND APPARATUS FOR SORTING WOOD CHIPS

BACKGROUND OF THE INVENTION

I. Field of the Invention

This invention relates to a method and apparatus for sorting particle matter, such as wood chips used in the manufacture of paper pulp.

II. Prior Art and Other Considerations

In the manufacture of paper pulp from wood chips it is economically advantageous that the constituent wood chips have a relatively uniform thickness in a desired thickness range. For a given mass of chips the desired thickness range is dependent upon several factors, such as characteristics of the wood stock from which the chips were generated and the condition of the chips, e.g., whether a significant number of the chips are fissured. An appropriate critical thickness range for commercial softwood chips, for example, is from about 6 millimiters to 8 millimeters. Prior art research and literature relative to chip thickness are discussed by R. D. Christie in articles entitled "Chip Screenings For Pulping Uniformity," 1986 *Pulping Conference*, pp. 551–561 (1986), and "Chip Thickness and Its Effect On Pulping Needs Further Study," *Pulp & Paper Canada* 87.9 (1986).

It is expedient, therefore, that a mass of chips emanating from a chipper of the like be sorted so that only chips belonging to the desired thickness range are actually introduced into the paper pulp process. To this end, devices generally known as "disc screens" have been used to separate or sort wood chips of varying thicknesses. Disc screens typically comprise a plurality of rows of revolvable disc members with the discs in each row disposed in spaced parallel relation along a common horizontal axis of rotation. The discs of adjacent rows intermesh radially with equal axial spaces therebetween to permit chips of no greater thickness than such spaces to pass downwardly between the intermeshing discs. The width of the spaces are thus controlled to correspond with the maximum desired thickness of accepted chips.

One prior art mode of arranging the rows of discs in a disc screen is for the axes of rotation for all the rows to be aligned in a horizontal plane as in the manner shown in U.S. Pat. No. 4,452,694 to Christensen et al. In such an arrangement, infeed occurs above a first of the rows of discs. The infeed is undirectionally transported over the discs toward output device. Chips having thickness less than the width of the space between adjacent intermeshing discs drop through the spaces, while thicker chips are transported to the last of the rows of discs and are discharged to the output device.

Another prior art mode is to arrange the rows of discs in a disc screen in a trough-like configuration as shown in U.S. Pat. No. 4,377,474 to Lindberg. Infeed of chips occurs proximate the center of the trough. The discs are rotated so that chips are thrown upwardly and outwardly from the center of the trough. Chips of desired thickness fall through the spacing between the intermeshed discs; larger chips are discharged from an outlet end of the trough.

Regardless of the mode of arrangement of the rows of discs, prior art disc screens, when operated without auxiliary screens, are generally incapable of filtering out very fine or undesized particulate matter such as dirt, grit, and bark particles. This undesized particulate matter is detrimental to the pulping process.

In addition, such undersize particulate matter can have an abrasive effect when striking the discs employed in the disc screen. Since, in prior art disc screens, infeed is consistently introduced into the same portion of the disc screen, and since the undersized particulate matter immediately passes through the disc spacing in the introductory portion of the screen, introductory discs suffer inordinate wear and require frequent replacement.

Moreover, in prior art disc screens, the chips must be oriented to stand on edge above the space between the intermeshing discs in order to pass therethrough. Since this is an unnatural chip orientation, the chips must be agitated in hopes that they will momentarily acquire this on-edge orientation and fall through the spaces. Numerous structured and operational modifications have been proposed to facilitate desirable chip orientation, including varying disc rotational speeds; varying the slope for trough-like disc screens; and varying disc size and shape. Prior art modifications have met with only limited success, however, in achieving desired chip orientation.

In view of the foregoing, it is an object of the present invention to provide method and apparatus for effectively sorting particles of desired thickness.

An advantage of the present invention is the provision of method and apparatus wherein an incoming mass of chips is distributed over a large portion of a disc screen.

An advantage of the present invention is the provision of method and apparatus for a disc screen wherein essentially uniform wear of the discs reduces the frequency of disc replacement.

Another advantage of the present invention is the provision method and apparatus for facilitating a desired orientation of chips in a disc screen so that acceptably sized chips can readily fall in spaces between intermeshing discs.

A further advantage by the present invention is the provision of method and apparatus for facilitating the expulsion of overthick chips from a disc screen.

Yet another advantage of the present invention is the provision of a durable disc for utilization in a disc screen.

SUMMARY

A wood chip sorter comprises a shell which at least partially defines a substantially cylindrical sorting chamber into which wood chips are introduced. The shell has a plurality of rotatable shafts mounted thereon with the axes of the shafts being circularly arranged about a central axis of the shell. Each shaft has a plurality of discs mounted at spaced intervals thereon with discs of adjacent shafts intermeshing radially to form essentially axial spaces therebetween. A drive and transmission system revolve the shell about the central axis of the shell. A planetary gear system facilitates rotation of the shafts about their axes as the shell revolves. Revolving of the shell, and hence the rotatable shafts, facilitates essentially uniform wear of the discs.

The discs mounted on the rotatable shafts are shaped to have greatest axial width at central portions thereof, and taper to a lesser axial width at their circumference. The discs are formed from an abrasion-resistant material. Compressible spacer members are mounted between adjacent discs on a shaft.

An inlet is configured to include a helically threaded feed member which extends into the shell and along the central axis thereof. The inlet facilitates input of the wood chips so that chips in a desired thickness range have the opportunity to pass through the axial spaces existing between intermeshing discs of adjacent shafts.

The effective minimum width of the spaces existing between intermeshing discs occurs in a plane passing through adjacent shafts. A somewhat wider space is thus provided above and below this plane. In view of the shape of the discs, chips which are properly oriented and trying to enter spaces between intermeshing discs will encounter a funneling effect that will assist in leading chips in the desired thickness range to and through the effective minimum width of the intermeshing disc space. Slightly oversized chips that enter between intermeshing discs are precluded from wedging between intermeshing discs by the rotation of adjacent discs, and by the revolution of the shafts about the central axis of the shell whereby oversized chips are carried above the axis from whence they fall by gravity. Revolution of the shell about its central axis facilitates agitation of the chips deposited therein, and provides repeated opportunity for a chip of acceptable thickness to acquire an orientation that will permit the chip to fall though a space between intermeshing discs.

BRIEF DESCRIPTION OF THE DRAWING

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

FIG. 2 is a sectioned view of the apparatus of FIG. 1 taken along the line 2—2;

FIG. 4A is a partial end view of two rotating shafts of the embodiment of FIG. 1 with intermeshing discs mounted thereon;

FIG. 4C is a side view of a portion of a rotating shaft of the embodiment of FIG. 1 with a plurality of discs mounted thereon; and, FIG. 5 is a sectioned view of the apparatus of FIG. 1 taken along the line 5—5 to show a planetary gearing system.

DETAILED DESCRIPTION OF THE DRAWINGS

Figure 1:
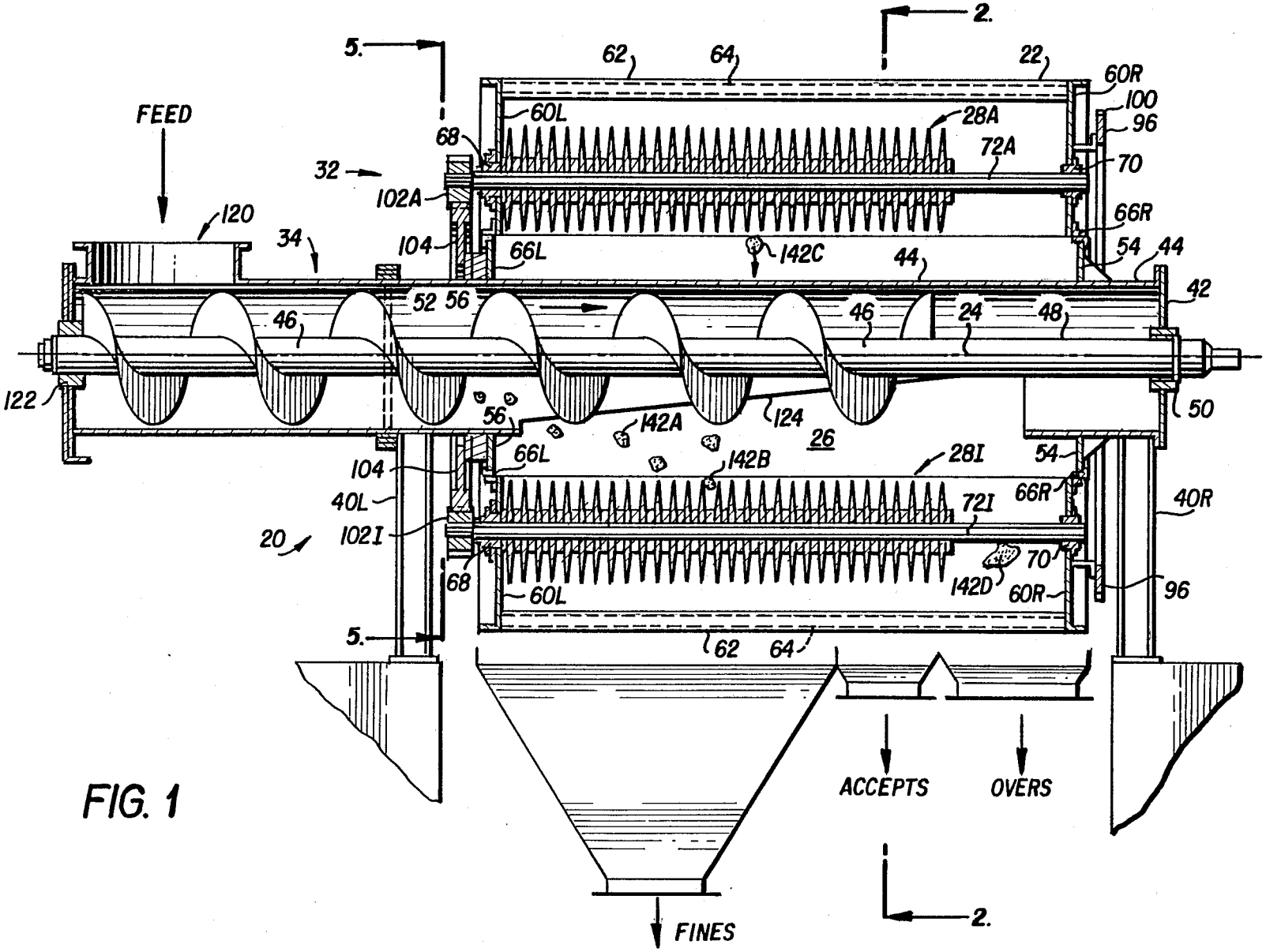
FIG. 1 is a cross-sectional side view of a wood chip sorting apparatus according to an embodiment of the invention.

The chip sorter of FIG. 1 comprises a frame 20; a shell 22 having a central axis 24 and which at least partially defines a sorting chamber 26; a plurality of shafts 28 rotatably mounted with respect to the shell 22; a drive a transmission system 30 (see FIG.5) for revolving the shell 22 about its central axis 24; a planetary gear system 32 for rotating the shafts 28; and, an inlet 34 for introducing an infeed of particle matter into the chamber 26 defined by the shell 22.

The frame 20 has two left legs 40L and two right legs 40R. The right legs 40R are connected to support a vertical rectangular right end plate 42. The end plate 42 has a right end of a center tube 44 attached thereto. The center tube 44 is essentially cylindrical in shape and has a major central axis which is collinear with the central axis 24 of the shell 22. As seen hereinafter, a helically threaded feed member 46 included in the inlet means 34 has a shaft 48 with a major axis which is also collinear with central axis 24. The right end plate 42 essentially closes the right end of the center tube 44, but a tip of the feed shaft 48 extends through a bearing 50 which is centrally carried on the end plate 42.

A comparable rectangular left end plate 52 is supported by the pair of left legs 40L. The left end of plate 52 has a central aperture therein sized to accommodate the left end of the center tube 44.

Proximate its right end the center tube 44 carries a stationary disc-shaped collar 54. Likewise, proximate its left end, the center tube 44 carries a stationary disc-shaped collar 56.

The shell 22 is configured to at least partially define a substantially cylindrical volume known as the sorting chamber 26. As mentioned before, the shell 22 has an interior or central axis 24 which is horizontal and collinear with the major axis of the center tube 44. The shell 22 has left and right disc-shaped end walls 60L and 60R, respectively. The shell left end wall 60L is connected to the shell right end wall 60R by a plurality of braces 62. The braces 62 are parallel to the central axis 24, e.g., the braces 62 run horizontally. In some embodiments, a cylindrical mesh screen is wrapped around the outside of the shell 22 at the location shown by broken lines 64 in order to separate very fine particulate matter. The end walls 60L, 60R are mounted by ring bearings 66L, 66R respectively, to revolve about the respective collars 56, 54 of the frame center tube 44.

The shell 22 carries the plurality of rotatable shafts 28. Sixteen such shafts 28P through 28B are shown in the illustrated embodiment (see FIG. 2). In particular, each shaft extends through a left bearing 68 mounted in the left end wall 60L and through a right bearing 70 mounted in the right end wall 60R. Each shaft 28 is mounted so that its axis of elongation 72 is parallel to the central axis 24 of the shell 22. Moreover, in a vertical plane as shown in FIG. 2, the axes of all shafts 28 are equidistant from the central axis 24 of all the shell 22. That is, the axes 72 of the shafts 28 are arranged at intervals in a circle about the central axis 24 of the shell 22.

Each shaft 28 is made from a cold finished steel shape, such as a hexagonal shape. Each shaft 28 is turned on its end as at 74 to accommodate the bearings 68, 70. An intermediate portion of the axial length of each shaft 28 has a plurality of discs 80 and spacers 82 mounted thereon in alternating sequence. For example, as shown in FIG. 4C, shaft 28I has mounted thereon disc 80I1 spacer 82I1, disc 80I2, spacer 82I2, and so forth.

Discs 80 of adjacent shafts 28 intermesh radially to form axial spaces 84 therebetween. As shown in FIGS. 4A and 4C, for example, shafts 28I, 28J have their axes 72I, 72J aligned in a plane depicted by broken line 86. Shafts 28I, 28J have discs 80I and 80J, respectively, mounted thereon with axial spaces 84 created between disc 80I1 and disc 80J1, and so forth.

Figure 4B:
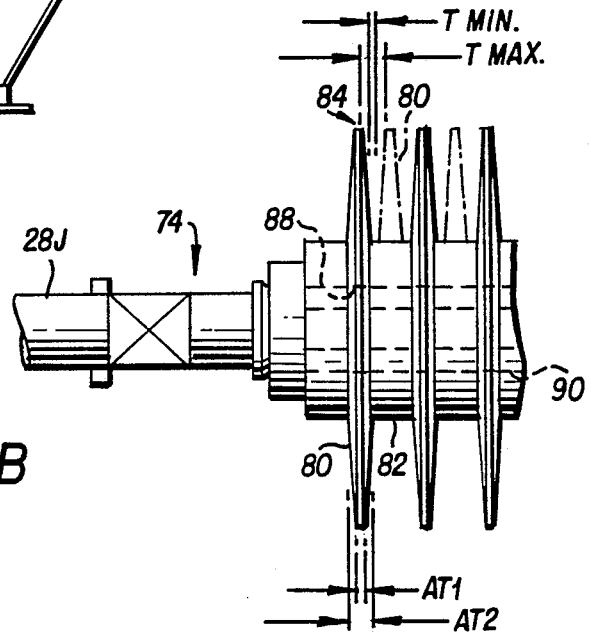
FIG. 4B is a partial top view of FIG. 4A.

As seen in FIG. 4B, each disc 80 has a first axial width AW1 at a central portion thereof. Each disc 80 tapers to a lesser axial width AW2 at a circumferential portion of the disc, so that the disc has an essentially beveled shape. Thus, as shown in FIG. 4B, a space 84 between intermeshing discs 80 has its minimum width WMIN in a plane extending through the axes of adjacent discs and its maximum width WMAX near the circumference of the discs.

Each disc 80 has a center hole 88 so that it can slide over its associated shaft 28. Likewise, each spacer 82 has a center hole 90 so that it can slide over its associated shaft 28. The discs 80 are molded from a plastic material such as ultra high molecular weight (U.H.M.W.) polyethylene, urethane, nylon, or delrin. These materials sustain less wear when handling abrasive elements and hence have longer service life than steel, for example. In some embodiments, the discs 80 are molded with a reinforcing material to stiffen the discs 80. The spacers 82 are fabricated from a softer plastic material than the discs 80, and preferably a slightly compressible material.

Figure 3:
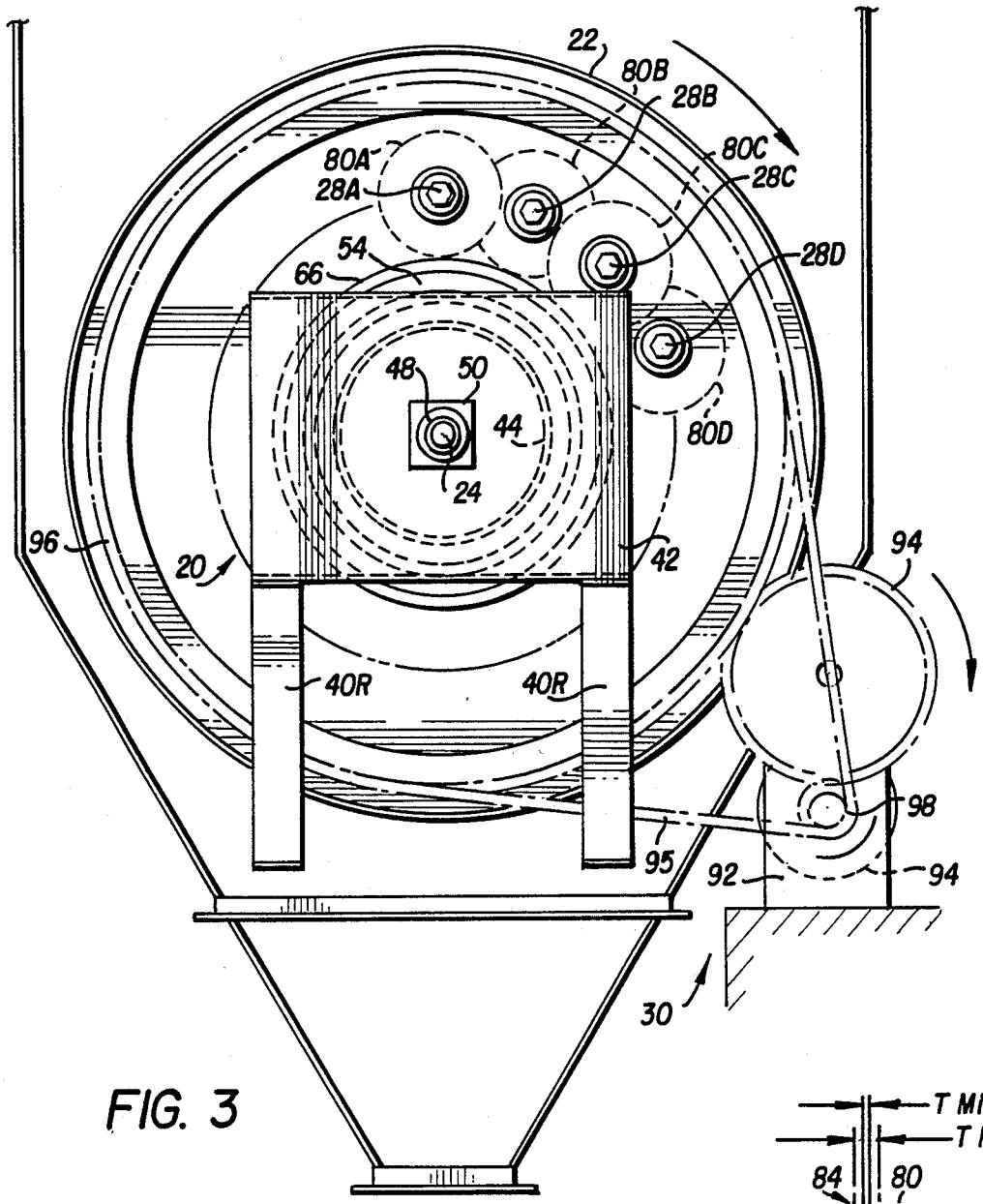
FIG. 3 is a right end view of the apparatus of FIG. 1.

As shown in FIG. 3, the drive and transmission system 30 includes a motor 92; a reduction gear 94; and an outer ring sprocket 96 mounted to the shell 22. Reduction gear 94 has a sprocket 98 which engages the drive chain 95. The drive chain 95 in turn meshes with outer circumferential teeth 100 provided on the outer sprocket 96 of the shell 22. As shown in FIG. 3, the reduction gear box sprocket 98 turns clockwise; and the shell 22 revolves in a clockwise direction about its central axis 24. The shell 22 is permitted to revolve about axis 24 by virtue of its mounting on frame 20 by the ring bearings 66. It should be understood that other types of drive and transmission systems can be utilized as, for example, a motor and gear drive for revolving the shell 22 about its axis 24.

The planetary gearing system 32 for rotating shafts 28 comprises planetary gears 102 carried by each rotating shaft 28; and, an inner ring gear 104 mounted on the left collar 56 of the frame 20. The planetary gears 102 are sized and positioned so that the circumferential teeth 110 thereon also mesh with circumferential T110 provided on the inner ring gear 104. Thus, as the shell 22 revolves in a clockwise direction, the planetary gears 102 causes each of the planetary gears 102 and the shafts 28 to which they are affixed to rotate in the clockwise direction. Rotation of the shafts 28 with respect to the shell 22 is facilitated by the left shaft bearings 68 and right shaft bearing 70.

The inlet 34 comprises the center tube 44 and an elbow-type introductory tube segment 120, as well as the afore-mentioned helicallythreaded feed member of auger 46. The auger 46, as mentioned before, has an axis which is collinear with the central axis 24 of the shell 22. The auger 46 is rotationally driven about its axis by unillustrated drive means and rotates with respect to tube segment 44 and end plate 42 by virtue of a bearing 122 and the afore-mentioned bearing 50. The center tube 44 has a cut-away portion 124 oriented so that chips ushered by auger 46 into the chamber 26 can fall by gravity onto the discs 80.

In operation, the drive and transmission system 30 causes the shell 22 to revolve about its central axis 24. Revolution of the shell 22 in the clockwise direction causes the shafts 28 carried thereon also to revolve about axis 24 in the clockwise direction. As the shafts 28 thusly revolve, the shafts 28 rotate about their own axis 72 by virtue of the planetary gearing system 32. Thus, the rotating shafts 28 (with discs 80 and spacers 82 thereon) revolve about central axis 24 in a circular circuit of travel. Moreover, a plurality of discs share essentially the same circuit of travel as the shafts 28 rotate about the central axis 24. For example, the discs 80I and 80K mounted of shafts 28I, 28K, and respectively, share the same circuit of travel, while discs 80J and 80L mounted on shafts 28J and 28L, respectively, share essentially the same circuit of travel.

A mass of wood chips is introduced into the introductory tube segment 120. As the auger 48 rotates about its axis, the chips are transported in the directions shown by arrow 140 into the center tube 44. Upon reaching the cut-away portion 124 of the center tube 44, the chips (such as chip 142A) fall by gravity onto the screen comprising the rotating discs 80. As the chips fall toward the disc 80 and into spaces 84 existing between intermeshing discs, the beveled shape of the discs result in the spaces 84 being essentially funnel-like in cross-section, with the effect that the wood chips are funneled to fall between the spaces at their thinnest dimension TMIN.

Only the chips belonging to the acceptable thickness range can pass through the spaces 84 existing between intermeshing discs 80. Should a wood chip become temporarily lodged between adjacent discs (as in the manner of chip 142B) the revolution of the shaft 28 and discs 80 about the central axis 24 at the rotation of each axis 28 enables the temporarily lodged chip to be carried or thrown overhead so that the chip assumes a position (as much as chip 142C) wherefrom the chip can again fall by gravity onto the lower-most ones of the rotating discs 80.

Oversized chips are not able to fall between the spaces 84 between intermeshing discs 80. Consequently, the oversized chips (such as chip 142D) are transported rightwardly (in the direction of arrow 140) to a region of chamber 26 whereat the shafts 28 do not have discs 80 mounted thereon. In this region the oversized chips fall by gravity between the shafts 80 and are discharged out an "OVERS" outlet.

Advantageously, revolving of the shaft 28 and disc mounted thereon about the central axis 24 results in the essentially uniform exposure of the disc 80 to incoming wood chips and other possibly abrasive materials. Inasmuch as a plurality of discs 80 share the same circuit of travel, uniform wear of the discs 80 is achieved. Further, as the discs 80 begin to wear, with the results of the spaces 84 become larger, the spaces 84 can be returned to their normal size by axially compressing the compressible spacers 82 and locking the disc 80 and spacers 82 back into a compressed position.

While the invention has been particularly shown and described with reference to the preferred embodiments thereof, it will be understood by those skilled in the art that various alterations in form and detail may be made therein without departing from the spirit and scope on the invention.

The embodiments of the invention in which an exclusive property or privilege is claimed are defined as follows:

1. An apparatus for sorting particle matter such as wood chips, said apparatus comprising:

means for defining a sorting chamber, said sorting chamber having an interior axis;

a plurality of rotatable shafts, each of said shafts having a plurality of discs mounted at intervals along at least a portion of an axial length of said shaft;

means for mounting said rotatable shafts in a manner whereby said rotatable shafts are arranged at intervals essentially completely about said interior axis of said sorting chamber and in a manner whereby discs of adjacent shafts intermesh radially defining axial spaces therebetween;

means for rotating said rotatable shafts about their respective axes;

means for revolving said plurality of rotatable shafts about said interior axis of said sorting chamber whereby said discs have a circuit of travel about said interior axis, and whereby a plurality of discs mounted on differing shafts share essentially the same circuit of travel; and, inlet means for introducing an infeed of particle matter at a location included in said shared circuit of travel in a manner whereby particle matter having thickness in a desired range has opportunity to pass through said axial spaces existing between intermeshing discs of adjacent shafts and thereby be sorted.

2. The apparatus of claim 1, wherein said dics have a first axial width at a central portion thereof and taper to a lesser axial width at a circumferential position thereof.

3. The apparatus of claim 1, wherein a space of minimum distance between intermeshing discs mounted on adjacent shafts occurs in a plane extending through the axes of the adjacent shafts.

4. The apparatus of claim 1, wherein said discs are formed from an abrasion resistant material chosen from a group consisting of polymers and elastomers.

5. The apparatus of claim 1, wherein compressible spacer members are mounted between adjacent discs along at least a portion of an axial length of said shafts.

6. The apparatus of claim 1, wherein said discs are formed from a metallic abrasion resistant material.

7. An apparatus for sorting particle matter such as wood chips, said apparatus comprising:

a frame;

a shell configured to at least partially define a substantially cylindrical volume having a horizontal central axis, said shell being mounted with respect to said frame to revolve about said central axis;

a plurality of shafts rotatably mounted with respect to said shell, said shafts having respective axes of elongation which are parallel to said central axis, said axes of elongation being equidistant in a vertical plane from said central axis in a vertical plane, said shafts having a plurality of discs mounted at intervals along at least a portion of an axial length of said shafts in a manner whereby discs of adjacent shafts intermesh radially to define axial spaces therebetween;

means for revolving said shell about said central axis;

means for rotating said rotatable shafts about their respective axes; and, inlet means for introducing and infeed of particle matter into the volume defined by said shell so that particle matter having a thickness in a desired thickness range has opportunity to pass through axial spaces existing between intermeshing discs of adjacent shafts and thereby be sorted.

8. The apparatus of claim 7, wherein said inlet means is configured to permit said infeed of particle matter to have a component of motion along said central axis.

9. The apparatus of claim 8, wherein said inlet means comprises a helically threaded feed member, said feed member extending at least partially into said volume defined by said shell having a major axis collinear with said central axis.

10. The apparatus of claim 7, wherein said means for rotating said rotatable shafts further comprises:

a central ring gear fixedly mounted with respect to said frame; and, gear members mounted on said plurality of rotatable shafts, said shaft gear members having at least circumferential portions thereof engageable with said central ring gear in a manner whereby said rotatable shafts rotate about their respective axes as said shell revolves about said central axis.

11. The apparatus of claim 7, wherein a circumferential portion of said shell is comprised of perforated material to permit the passage of fine particulate matter therethrough.

12. The apparatus of claim 7, wherein said discs have first axial width at a central portion thereof and taper to a lesser axial width at a circumferential portion thereof.

13. The apparatus of claim 12, wherein a space of minimum width between intermeshing discs mounted on adjacent shafts occurs in a plane extending through the axes of the adjacent shafts.

14. The apparatus of claim 7, wherein said discs are formed from an abrasion resistant material chosen from a group consisting of polymers and elastomers.

15. The apparatus of claim 7, wherein compressible spacer members are mounted between adjacent discs along at least a portion of an axial length of said shafts.

16. The apparatus of claim 7, wherein said discs are formed from a metallic abrasion resistant material.

17. A method of sorting particle matter such as wood chips, said method comprising the steps of:

introducing an infeed of particle matter into a sorting chamber, said sorting chamber having a horizontal axis;

depositing said introduced infeed of particle matter onto a screen comprising said sorting chamber, said screen being comprised of a plurality of discs, a plurality of such discs being mounted at intervals along at least a portion of an axial length of each of a plurality of rotatable shafts, said discs of adjacent shafts intermeshing radially to define axial spaces therebetween, said axial spacing being chosen to permit only particle matter having thickness in a desired thickness range to fall therethrough;

rotating said shafts about their respective axes; and, revolving said rotatable shafts about a horizontal axis of said sorting chamber.

18. The method of claim 17, wherein said infeed is introduced into said chamber in a manner whereby said infeed acquires a component of motion along said horizontal axis of said sorting chamber.

* * * * *